US005882283A

United States Patent [19]

Stevens

[11] Patent Number: 5,882,283

[45] Date of Patent: Mar. 16, 1999

[54] FOLDABLE WEIGHTLIFTING BENCH

[76] Inventor: Clive Graham Stevens, 372 Hills Borough Rd., Aukland, New Zealand

[21] Appl. No.: 885,556

[22] Filed: Jun. 30, 1997

[30] Foreign Application Priority Data

Aug. 11, 1996 [CH] Switzerland ..... 85217122

[51] Int. Cl.[6] ..... A63B 21/078

[52] U.S. Cl. ..... 482/104; 482/142

[58] Field of Search ..... 482/104, 130, 482/133–138, 142, 144; 5/133, 136, 178, 620; 297/354, 13, 372

[56] References Cited

U.S. PATENT DOCUMENTS 3,456,269 7/1969 Goodman ..... 5/178

4,826,255 5/1989 Lahman ..... 482/142

*Primary Examiner*—John Mulcahy

*Attorney, Agent, or Firm*—Norman E. Lehrer

[57] ABSTRACT

A foldable weightlifting bench includes a pair of supporting members each have a post and a transverse bar connected to a lower end of the post. A first connecting rod and a second connected rod are respectively connected between the two posts and the two transverse bars. A base member is pivotally connected to the first connecting rod and located between the two posts, the base member having a stand pivotally connected thereto. A retractable device pivotally connected between the second connecting rod and the base member. A link pivotally connected between the stand and the retractable device. The base member is pivoted about the first connecting rod and the retractable device is then extended to support the base member positioned at an upright position.

3 Claims, 5 Drawing Sheets

FOLDABLE WEIGHTLIFTING BENCH

BACKGROUND OF THE INVENTION

1. Field of the Invention

The present invention relates to a foldable weightlifting bench which is designed to be folded to a compact size for convenient storage and transportation.

2. Brief Description of the Prior Art

A conventional weightlifting bench is relatively large and, therefore, occupies a substantial amount of space. It is not convenient for transportation and storage. If the weightlifting bench is used in home, rather than a commercial location such as a health or fitness club, it is desirable to store the bench when not in use.

The present invention intends to provide a foldable weightlifting bench which can be folded so as to mitigate and/or obviate the above-mentioned problem.

SUMMARY OF THE INVENTION

The present invention provides a foldable weightlifting bench includes a pair of supporting members each having a post and a transverse bar. A first connecting rod is connected between the two posts and a second connecting rod is connected between the two transverse bars.

A base member has a first end with a first tube rotatably mounted to the first connecting rod and a second end having an end tube formed thereto. The base member has a first lug and a second lug respectively and downwardly extending from a periphery thereof. A stand is pivotally connected to the first lug and has a third lug disposed thereto.

A retractable means includes an outer tube and an inner tube which is retractably received in the outer tube and pivotally connected to the second lug. The outer tube has a second tube transversely connected thereto so as to be rotatably mounted to the second connecting rod, and at least one first hole defined in a periphery thereof, the inner tube having a plurality of second holes defined therein so that the inner tube is positioned corresponding to the outer tube by extending a pin through the first hole and one of the second holes. The outer tube has a fourth lug extending laterally therefrom so that a link is pivotally connected between the third and the fourth lug.

It is an object of the present invention to provide a foldable weightlifting bench wherein a base member is pivoted to an upright position so as to occupy a small space.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
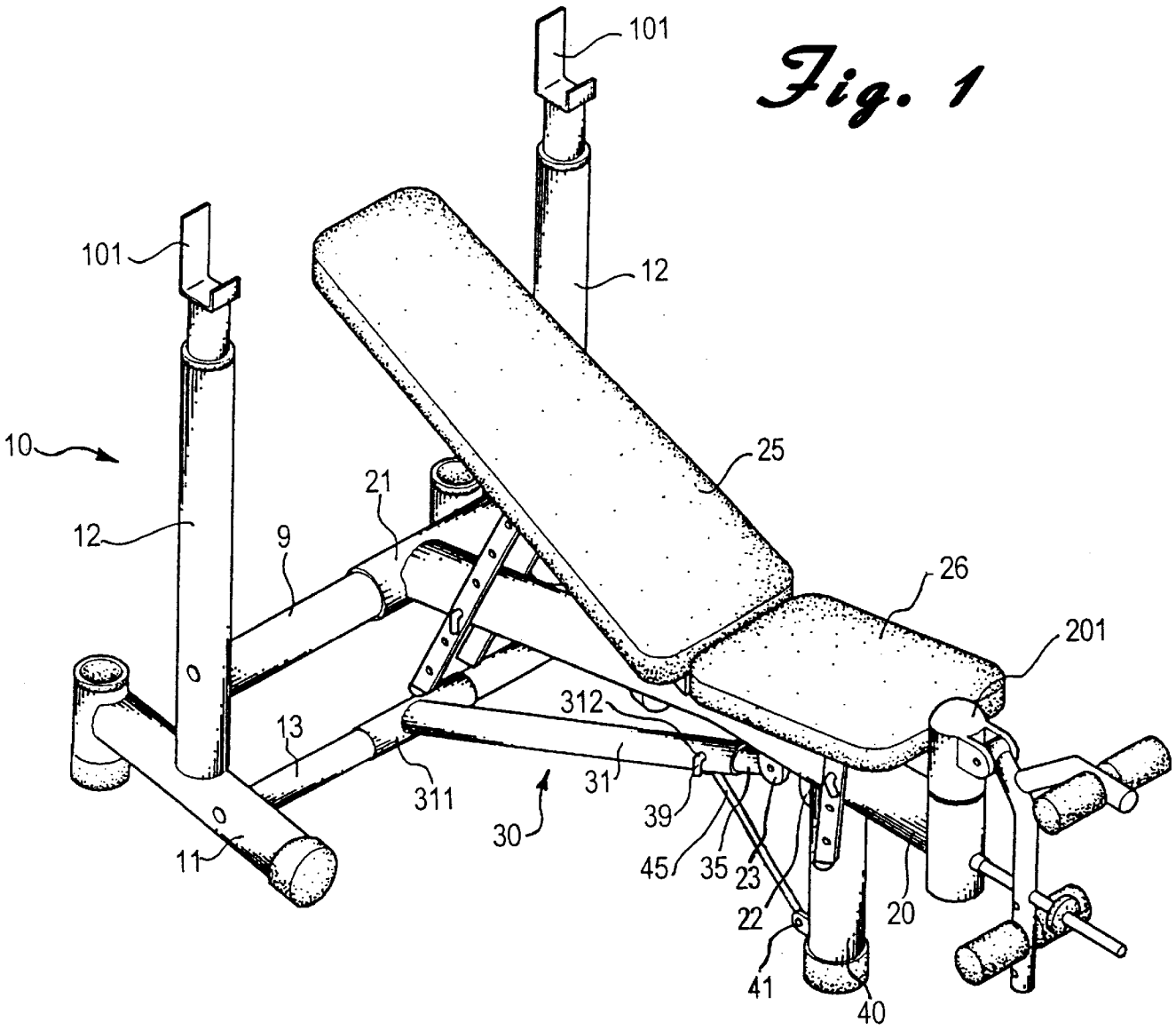
FIG. 1 is a perspective view of a foldable weightlifting bench in accordance with the present invention.
Figure 2:
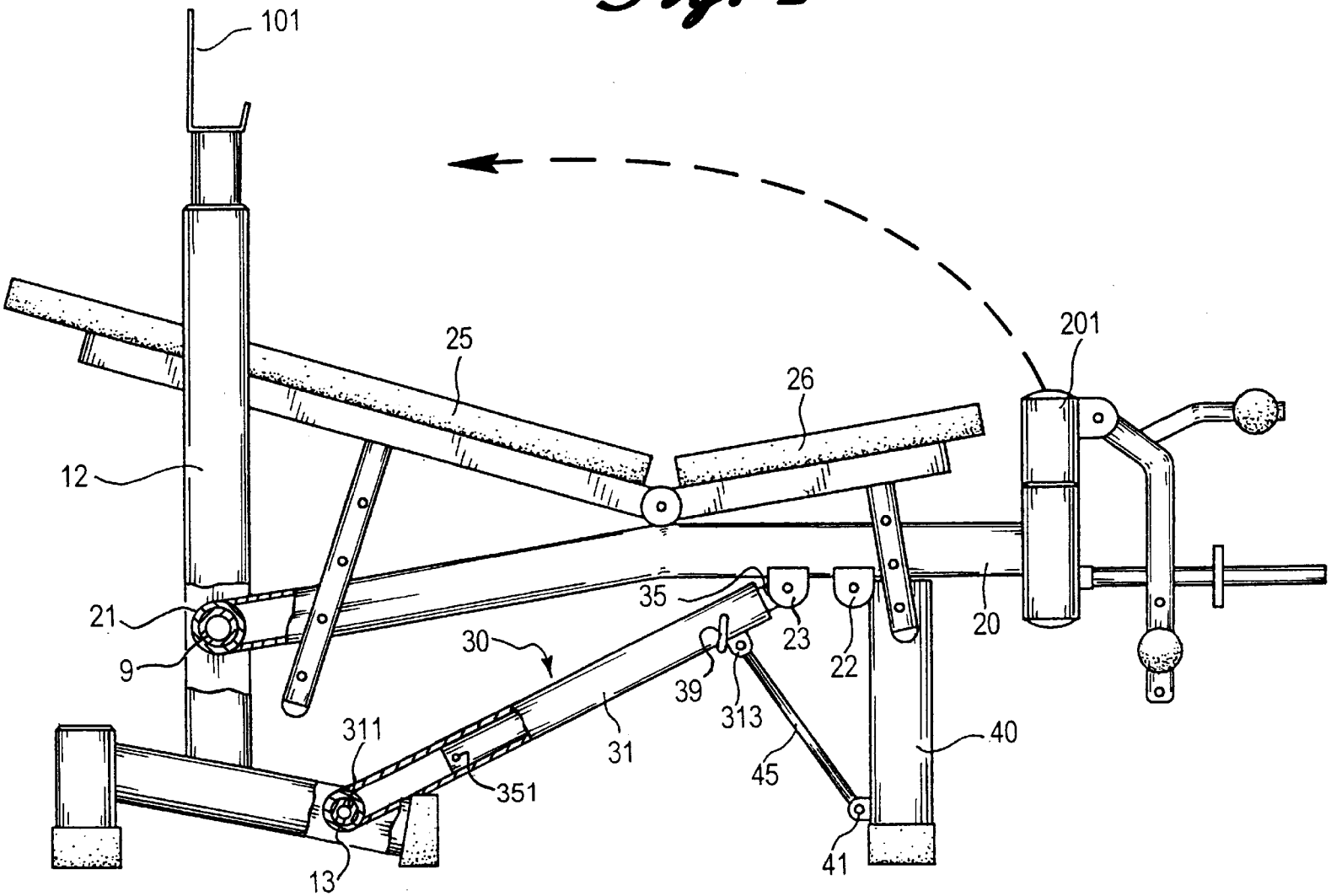
FIG. 2 is a side elevational view, partly in section, of the bench and shows the direction to which a base member thereof is pivoted.

Referring to the drawings and initially to FIGS. 1 and 2, a foldable weightlifting bench in accordance with the present invention generally includes a pair of supporting members 10 each having a post 12 and a transverse bar 11 connected to a lower end, of the post 12 corresponding thereto. Each of the posts 12 has a U-shaped bracket 101 disposed to an upper end thereof so as to support a weight between the two brackets 101. A first connecting rod 9 is connected between the two posts 12 and a second connecting rod 13 is connected between the two transverse bars 11.

A base member 20 has a first end with a first tube 21 formed transversely thereto which is rotatably mounted to the first connecting rod 12 and a second end with an end tube 201 formed thereto. The base member 20 has a first lug 22 and a second lug 23 respectively and downwardly extending from a periphery thereof. As shown in FIG. 1, in a preferred embodiment of the invention, a back support 25 and a seat 26 form a bench top and are respectively disposed to the base member 20. A stand 40 is pivotally connected to the first lug 22 and has a third lug 41 disposed thereto so that the seat 26 is maintained horizontal.

A retractable means 30 includes an outer tube 31 and an inner tube 35 which is retractably received in the outer tube 31 and pivotally connected to the second lug 23. The outer tube 31 has a second tube 311 transversely connected thereto so as to be rotatably mounted to the second connecting rod 13. The outer tube 31 has at least one first hole 312 defined in a periphery thereof and the inner tube 35 has a plurality of second holes 351 defined therein so that the inner tube 35 is positioned corresponding to the outer tube 31 by extending a pin 39 through the first hole and one of the second holes 351. A fourth lug 313 extends laterally from the outer tube 31. A link 45 is pivotally connected between the third and the fourth lug 41, 313.

Figure 3:
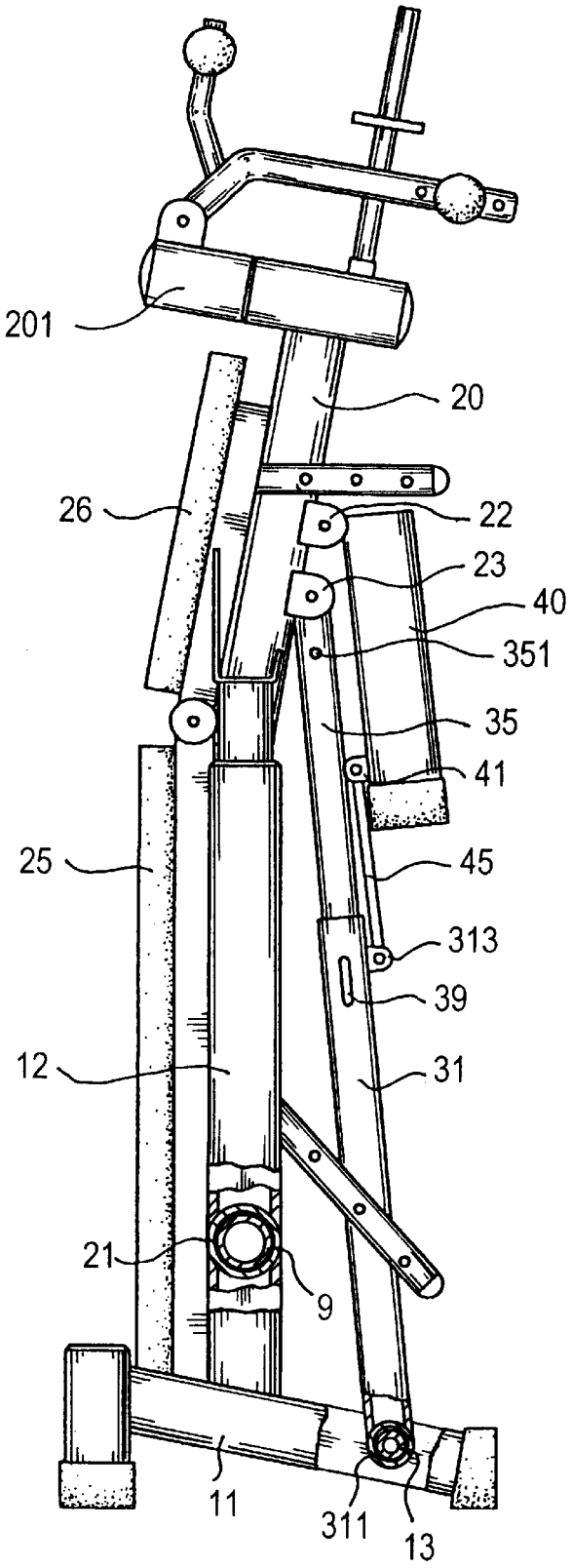
FIG. 3 is a side elevational view, partly in section, of the bench when the base member is positioned at the upright position.

When folding the base member 20 together with the back support 25 and the seat 26, the pin 39 is withdrawn from the inner tube 35 and the outer tube 31 and the base member 20 is then pivoted about the first connecting rod 9 toward the directions shown in an arrow head in FIG. 2. The inner tube 35 is extended when pivoting the base member 20 till the base member 20 is pivoted to an upright position as shown in FIG. 3, the pin 39 then is inserted into the aligned first hole 312 and the second hole 351 again so that the base member 20 is supported by the retractable means 30. When the base member 20 is pivoted, the stand 40 will be pulled by the link 45 to be pivoted about the first lug 22 to a position as shown in FIG. 3.

Figure 4:
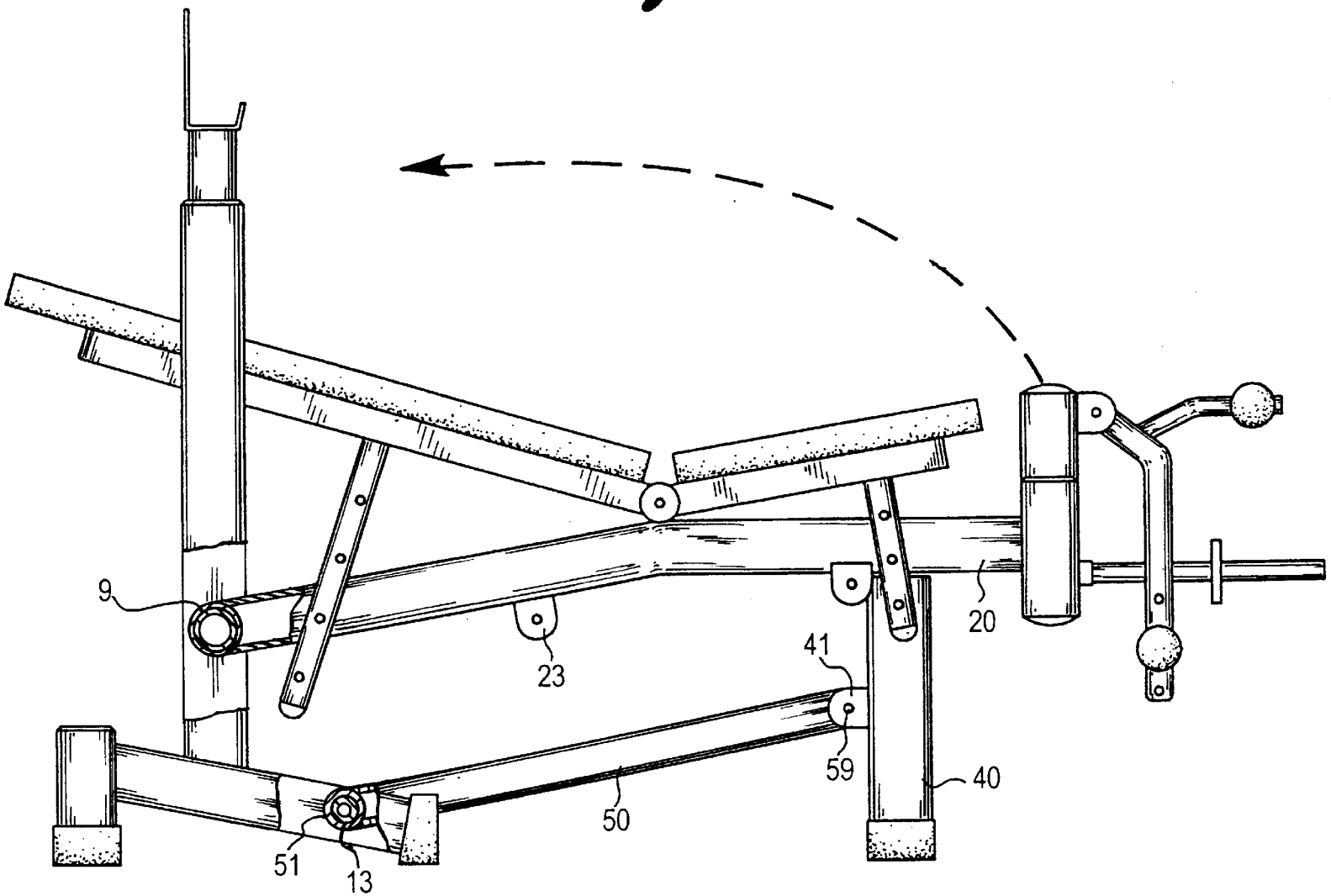
FIG. 4 is a side elevational view, partly in section, of another embodiment of the bench and shows the direction to which a base member is pivoted.
Figure 5:
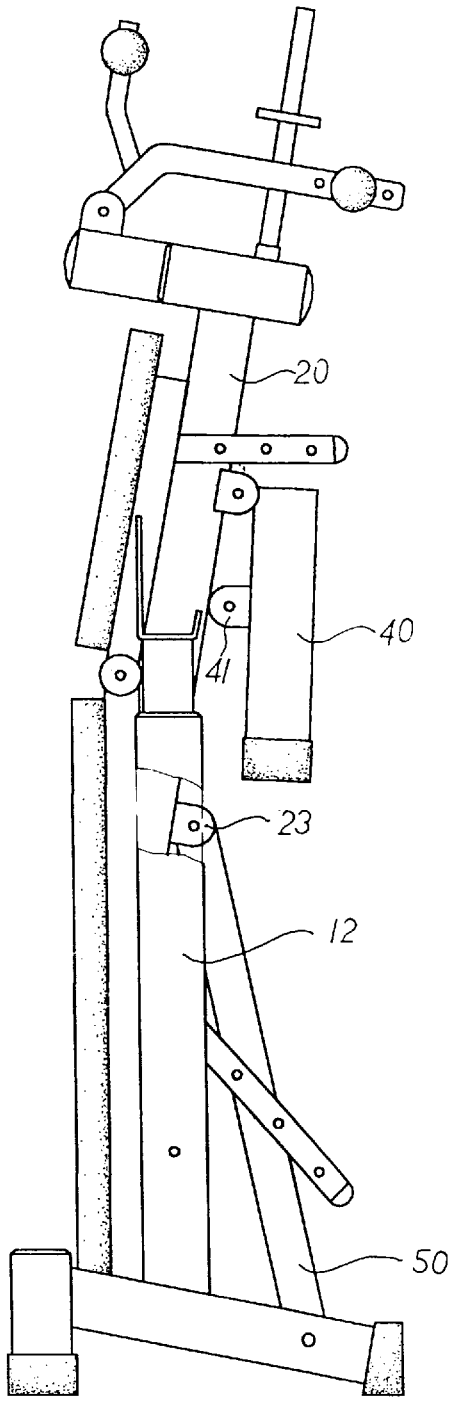
FIG. 5 is a side elevational view of the bench when the base member is positioned at the upright position.

FIG. 4 shows another embodiment of the foldable weightlifting bench which comprises the same structure as that shown in FIGS. 1–3 except that the embodiment shown in FIGS. 4 and 5 has no retractable means and the link as shown in FIGS. 1–3.

A third connecting rod 50 has a first end with a short tube 51 formed transversely thereto which is rotatably mounted to the second connecting rod 13, and a second end pivotally connected to the third lug 41 by extending a pin 59 therethrough. When folding the weightlifting bench, referring to FIG. 5, the pin 59 is first withdrawn from the third lug 41 and then the base member 20 is pivoted about the first connecting rod 9 toward the direction shown by an arrow head as shown in FIG. 4. The second end of the third connecting rod 50 is then shifted to connect the third lug 23 by extending the pin 59 through the third lug 23 again to support the base member 20 maintained upright. The stand 40 is maintained upright by gravity.

Accordingly, the weightlifting bench can be folded to a compact size by a simple process and the base member 20 is well supported when folded and will not drop down.

Although the invention has been explained in relation to its preferred embodiment, it is to be understood that many other possible modifications and variations can be made without departing from the spirit and scope of the invention as hereinafter claimed.

What is claimed is:

1. A foldable weightlifting bench comprising:

a pair of supporting members each having a post and a transverse bar connected to a lower end of said post corresponding thereto, a first connecting rod connected between said two posts and a second connecting rod connected between said two transverse bars;

a base member having a first end with a first tube formed transversely thereto and a second end with an end tube formed thereto, said base member having a first lug and a second lug respectively and downwardly extending from a periphery thereof, said first tube rotatably mounted to said first connecting rod; a bench top disposed on said base member;

a stand pivotally connected to said first lug and having a third lug disposed thereto;

a retractable means including an outer tube and an inner tube which is retractably received in said outer tube and pivotally connected to said second lug, said outer tube having a second tube transversely connected thereto so as to be rotatably mounted to said second connecting rod, said outer tube having at least one first hole defined in a periphery thereof and said inner tube having a plurality of second holes defined therein so that said inner tube is positioned corresponding to said outer tube by extending a pin through said first hole and one of said second holes, a fourth lug extending laterally from said outer tube, and a link pivotally connected between said third and said fourth lug.

2. The foldable weight lifting bench as claimed in claim 1 wherein said bench top comprises a back support and a seat.

3. The foldable weightlifting bench as claimed in claim 1 wherein each of said posts has a U-shaped bracket disposed to an upper end thereof.

* * * * *